United States Patent [19]

Yasuhara

[11] Patent Number: 4,470,763

[45] Date of Patent: Sep. 11, 1984

[54] FUEL INJECTION CONTROL SYSTEM

[75] Inventor: Seishi Yasuhara, Yokosuka, Japan

[73] Assignee: Nissan Motor Company, Japan

[21] Appl. No.: 225,372

[22] Filed: Jan. 15, 1981

[30] Foreign Application Priority Data

Jan. 17, 1980 [JP] Japan ..... 55-3971

[51] Int. Cl.[3] ..... F04B 49/06; F02M 59/20

[52] U.S. Cl. ..... 417/289; 417/500; 123/357; 123/449

[58] Field of Search ..... 417/282, 289, 293, 500; 123/357, 449, 503

[56] References Cited

U.S. PATENT DOCUMENTS

| | | | |
|---|---|---|---|
| 3,630,643 | 12/1971 | Eheim et al. | 417/289 X |
| 3,945,360 | 5/1976 | Laufer | 417/289 |
| 4,192,398 | 3/1980 | Hunt | 123/357 X |
| 4,318,378 | 3/1982 | Eheim | 123/357 |

FOREIGN PATENT DOCUMENTS

| | | |
|---|---|---|
| 2349553 | 10/1975 | Fed. Rep. of Germany . |
| 1075445 | 7/1967 | United Kingdom . |
| 1251447 | 10/1971 | United Kingdom . |
| 1287822 | 9/1972 | United Kingdom . |
| 1369495 | 9/1974 | United Kingdom . |
| 1462871 | 9/1977 | United Kingdom . |

*Primary Examiner*—Richard E. Gluck

*Attorney, Agent, or Firm*—Lowe, King, Price & Becker

[57] ABSTRACT

An electrical motor controls the movement of a slider threaded over a threaded shaft of the motor. A sensor detects the position of the slider along the threaded shaft to control the movement of the motor which is also controlled by the operational state of the engine. The slider controls the position of a control sleeve fitted slidably over a fuel distributing plunger relative to the plunger so that the sleeve opens and closes a spill port provided in the side surface of the plunger in order to control the amount of fuel supplied to the engine cylinders.

11 Claims, 10 Drawing Figures

FUEL INJECTION CONTROL SYSTEM

BACKGROUND OF THE INVENTION

1. Field of the Invention

The present invention relates to fuel injection control systems for internal combustion engines, and more particularly to improvements in fuel injection control systems of the type wherein a plunger cooperates with an adjusting member to determine the beginning and/or termination of fuel admission into the cylinders and thus to control the amounts of injected fuel.

2. Description of the Prior Art

U.S. Pat. No. 3,630,643 to Frang Eheim and assigned to Robert Bosch GmbH discloses a fuel injection pump for internal combustion engines, particularly for diesel engines. The pump comprises an engine-driven distributing member which is installed in the housing and serves to admit metered quantities of fuel to the cylinders of the engine, and a control circuit arranged to produce control signals whose characteristics vary as function of changes in rotational speed of the engine. A transducer means is provided in the housing and responds to the control signals to influence the distribution of fuel by the distributor member, for example by determining the beginning or the termination of fuel injection. The transducer means comprises an electromagnet which is energizable by the control signals and has a rotary armature whose angular position is a function of the characteristics of control signals. The transducer means includes a shaft which is rotatable with the armature, an eccentric mounted on the shaft, a collar surrounding and movable axially of the distributing member to thereby influence the distribution of fuel to the cylinders, and a ball-and-socket connection between the collar and the eccentric.

The pump, however, determines the amounts of fuel injected into the cylinders within a relatively narrow range of rotation angle of the armature by means of the shaft which rotates with the armature. Thus precise control of fuel injection is relatively difficult.

The present invention contemplates more precise control of the fuel amounts injected to the engine cylinders.

SUMMARY OF THE INVENTION

The present invention provides a fuel injection control system wherein a fuel distributing plunger moves angularly and axially thereof in synchronism with the rotational speed of said engine. The plunger cooperates with a control sleeve to open and close a spill port provided in the plunger to control the amount of fuel injected into the engine. A slider is provided which is moved by an electric motor along the motor shaft and controls the position of the control sleeve relative to the spill port through a linkage. A sensor is provided for sensing the position of the slider along the motor shaft to supply a signal representing the position of the slider. The motor responds to the signal from the sensor and to the operational state of the engine to control the slider.

Means may be provided for limiting the maximum speed of the motor, using the fluid resistance imparted to the motor while the motor is operating. Further, means may be provided along the motor shaft for preventing mechanical damage of the slider and the sensor.

BRIEF DESCRIPTION OF THE DRAWINGS

This and other objects, features and advantages of the present invention will be apparent from the following description of preferred and alternative embodiments thereof, taken in conjunction with the drawings in which the same reference numerals designate corresponding parts throughout the drawings and in which.

DETAILED DESCRIPTION OF THE EMBODIMENTS

Figure 1:
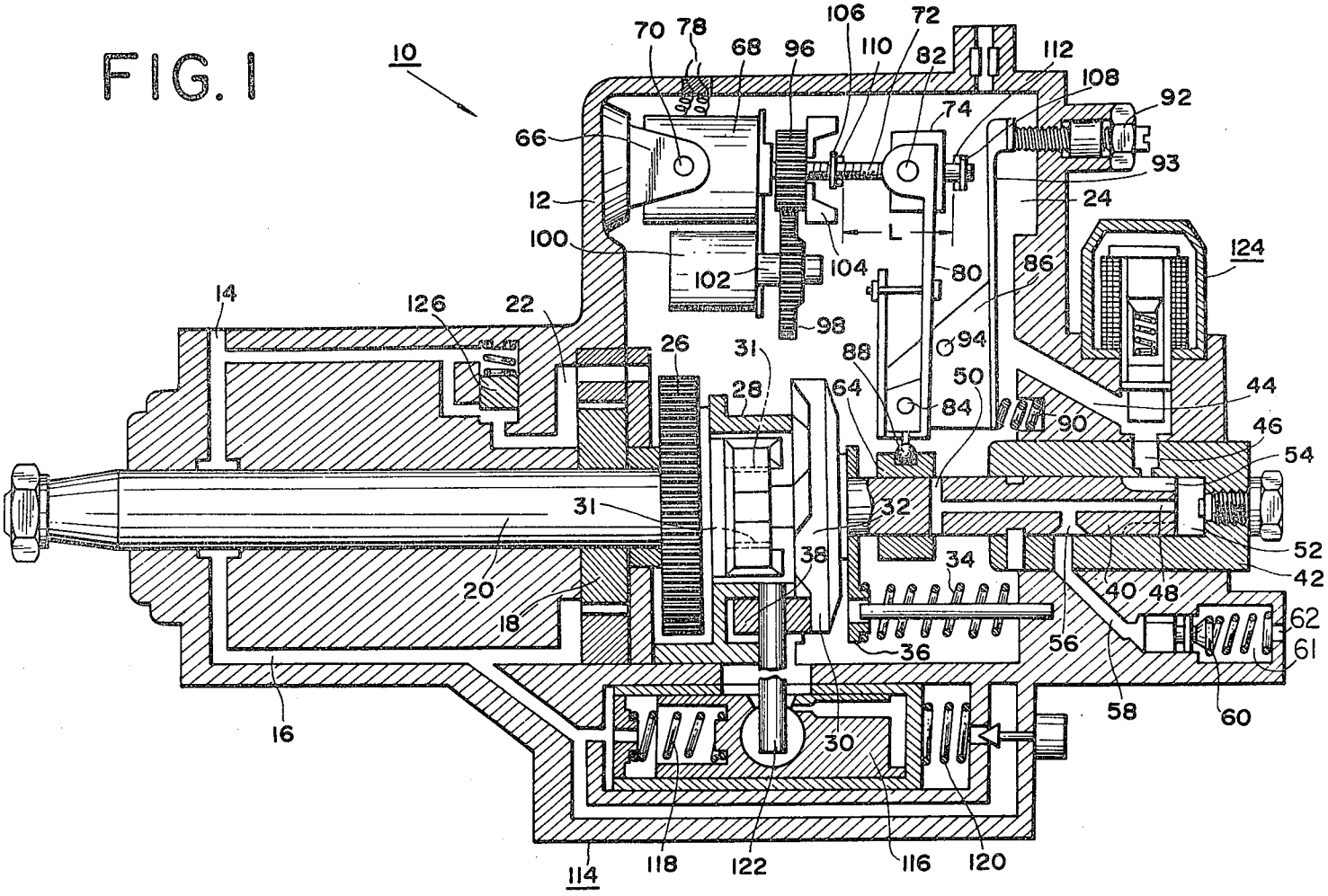
FIG. 1 is a diagrammatical sectional view of a preferred embodiment of a fuel injection system according to the present invention.

Referring to the drawings and particularly to FIG. 1, there is shown a preferred embodiment of a fuel injection control system according to the present invention, generally designated by reference numeral 10. The system includes a housing 12 with a fuel inlet 14 and a fuel passage 16 communicating therewith. A rotary feed pump 18 is enclosed within the housing 12 and driven by a drive shaft 20, to which the pump 18 is secured, and coupled with the crankshaft to supply fuel admitted from the inlet 14 through the passage 16 and another passage 22 to a reservoir 24 formed by the housing 12. A disc 26 is fixed to one end of the drive shaft 20 and supports a cylindrical member 28 such that this cylindrical member can rotate about the axis of the drive shaft 20 relative to the disc 26. A cam disc 30, which controls the timing at which fuel is injected into the engine cylinders, not shown, is coupled by keys 31 to the drive shaft such that it can easily move axially of the drive shaft relative to the same but rotates together with the drive shaft. The cam disc has a plurality of cam faces 32 whose number corresponds to the number of engine cylinders. The cam disc is urged toward the cylindrical member 28 by a biasing plate 36 and plunger spring 34. The cam disc reciprocates axially through a predetermined amount of cam lift when each cam face passes over a roller 38 pivoted by a connecting rod 122 to the cylindrical member 28 while the cam disc is being rotated by the drive shaft 20.

A fuel supply plunger 40 secured to the cam disc 30 moves angularly and axially of the drive shaft 20 in a cylinder 42 secured to the housing 12 when the drive shaft 20 is driven. The cylinder 42 is provided with an intake port 46 which communicates with the reservoir 24 through a fuel supply passage 44. The plunger 40 is provided with a central axial passage 48 and a spill port 50 communicating therewith and extending transversely of the plunger 40 to release the pressure from a high pressure chamber 52 formed by the plunger 40 and the cylinder 42. The plunger 40 has therein an intake groove 54 through which the intake port 46 and the high pressure chamber 52 communicate according to the phase of the plunger 40, and a distributor port 56 communicating with the central passage 48 and opening to the side surface of the plunger. Fuel under pressure is distributed from the distributor port 56 through one of a plurality of output passages 58 provided in the housing 12 to a corresponding delivery valve 60, overcoming the return force of a spring 61 in the housing 12, and passes through a fuel outlet 62 to an injection nozzle, not shown. A control sleeve 64 controls the opening of the spill port 50, as will be described in more detail below.

An electric motor 68 of for example DC type, driven by an external signal, is pivotally supported at a point 70 on each side of the motor by a bracket 66 fixed to the inner wall surface of the housing 12. The motor has a threaded drive shaft 72 on which a slider 74 is threaded. When the motor is operated, the slider moves toward or away from the motor 68 along the drive shaft 72 to move a link 80 to position the control sleeve 64 relative to the position of the spill port 50, thereby controlling the termination of fuel injection and hence the amount of fuel injected, when the motor receives a command through leads 78 from a control device, not shown, disposed outside the housing 12. The motor shaft 72 has a gear 96 secured thereto with which a gear 98 secured to the shaft 102 of a potentiometer 100 meshes. Rotation of the gear 98 continuously changes the resistance of the potentiometer 100 to detect the position of the slider 74 along the drive shaft 72 to output a signal representing the position of the slider. This signal is used as a feedback signal for performing control of the motor 68.

The link 80 is pivoted at 82 to the slider 74 and at 84 to an adjustment plate 86, and is provided with a ball member 88 which engages with the control sleeve 64. The adjustment plate 86 is urged at its lower end toward the cam disc 30 by a spring 90 received in a recess in the housing 12 wall and is positioned so as to adjust the maximum fuel injection amount by a screw 92 threaded into the housing 12 and fixed at one end to an arm 93, the other end of which is fixed to the adjustment plate 86.

A fuel cutoff valve 124 closes the passage 44 when the engine is stopped, for example by turning off the ignition switch, not shown, in order to stop the supply of fuel to the high pressure chamber 52. A pressure control valve 126 controls the pressure of the fuel supplied from the pump 18 to the reservoir 24.

The gear 96 of the motor shaft 72 is provided with a plurality of vanes 104 which rotate together with the gear. The motor shaft 72 is provided with opposing stops 106 and 108 for stopping the slider 74. These stops have O-ring buffers made of, for example, rubber 110 and 112 and limit the range L through which the slider can 74 move. The range L is determined by the range through which the control sleeve 64 must be moved in order to provide the necessary range of fuel injection amounts. The number of rotations of the motor 68 required for the movement of the slider 74 is determined by the pitch of the thread of the motor shaft 72. Accordingly, if the potentiometer 100 is of a conventional ten-rotation type, and if the number of teeth of the gear 96 is A and the number of teeth of the gear 98 is B, the thread pitch P and the gear ratio B/A are related by:

$$L = 10 \times (B/A) \times P$$

In order to prevent the movable member of the potentiometer 100 from hitting a stop thereof, not shown, for example, eight rotations of the potentiometer may be used as the actual range of use, and the remaining two rotations kept as leeway for preventing the movable member of the potentiometer from hitting its stop.

A fuel injection timing control device 114 includes a plunger piston 116 operated by the pressure of fuel taken therein through the passage 16 and is urged to an initial position by a pair of springs 118, 120 disposed one on each side of the plunger.

The connecting rod 122 connects piston 116 and the cylindrical member 28 so that the cylindrical member 28 is rotated about the axis of the shaft 20 independently of the disc 26 by the movement of the piston 116. The plunger 116 is moved axially in the casing according to the pressure of fuel from the feed pump 18 to turn the connecting rod 122 about the axis of the shaft 20 by the corresponding angle in order to adjust the timing of axial movement of the plunger 40 caused by the roller 38 bearing on the cam faces of the cam disc 30, thereby controlling the timing of fuel injection and the beginning of compressing fuel in the pressure chamber 52. For easy understanding, the timing control device 114 is shown rotated through 90° about the connecting rod 122.

In operation, when the load on the engine increases, the electric motor 68 rotates in a predetermined direction according to a command from the external control device, not shown. The slider 74 is drawn toward the motor 68 so that the link 80 turns about the pivot 84 to move the control sleeve 64 toward the cylinder 42. Thus the time interval for which the spill port 84 is closed by the control sleeve increases during the step of compressing the fuel in the plunger, to increase the amount of fuel injected into the distribution port 56. On the other hand, when the load decreases, the motor 68 is reversed by the signal from the control device, thereby moving the control sleeve 64 toward the cam disc 30 to advance the timing of opening the spill port 50 and thus decrease the amount of fuel injected into the engine cylinders.

If the distance between the pivot 84 of the link lever 80 and the ball 88 is one fourth to one sixth, and preferably one fifth of the distance between the pivots 82 and 84, the movement of the slider 74 due to the motor operation will be about five times as large as that of the control sleeve 64, thereby providing easy and precise control of the control sleeve.

The total load applied to the motor 68 is the sum of the resistance to the movement of the potentiometer 100, the resistance to the movement of the slider 74, the inertia of the driving system, and the resistance to the stirring of the fuel by the armature of the motor 68, but equals substantially zero load. Such a load allows the motor speed to rise to 2,000 to 10,000 rpm which is somewhat too high for this application. An example characteristic curve of the motor speed against time, after application of the voltage to the motor, is shown by (a) in FIG. 2. For example, the motor speed may reach its highest value at the time t when the slider 74 has travelled its whole stroke and is required to stop so that an overshoot and the load applied on collision are maximum, as shown by the broken line Y in FIG. 3, for the command value shown by the solid line X.

Figure 2:
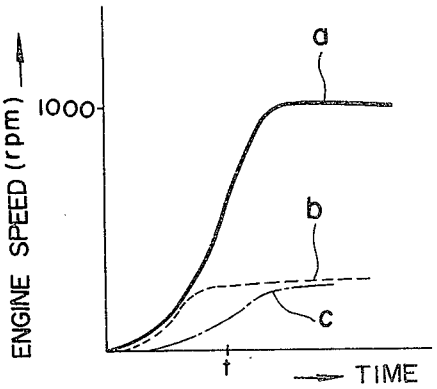
FIG. 2 is a graphical representation showing electric motor time-speed characteristics.

The provision of the vanes 104 on the motor gear 96 applies to the motor a resistance load proportional to the $\alpha$'th power of its rotational speed, $\alpha$ being determined from the viscosity of fuel imparting fluid resistance to the vanes, thereby restricting the motor speed to a moderate speed, as shown by (b) in FIG. 2 substantially without affecting the rising characteristic of the motor at low speeds. The use of the relative size of the vanes 104 to other structural components will result in enough advantage.

On the other hand, in order to restrict the maximum speed of the motor, a device has been proposed which is provided with a speed governor in the control circuit, or with means for lowering the drive voltage applied to the motor. However, the lowering of the drive voltage results in a characteristic curve such as shown by (c) in FIG. 2, showing an increase in the time during which the slider 74 moves, as well as a slowly rising characteristic of the motor speed, thereby degrading the response of the slider to a command requiring a small movement, a very frequent requirement.

In order to detect the position of the slider 74 as precisely as possible a maximum value of rotation of the potentiometer 100 should preferably correspond to the distance of movement L of the slider 74 in terms of the blind zone of rotation of the motor 68 and the resolution of the potentiometer 100.

Thus, the stops 106, 112 provided with the buffer members 110, 112 are preferably positioned on the shaft 72 so that the slider hits the stops immediately before the sliding member, not shown, of the potentiometer hits its stops, not shown, so as to protect the potentiometer stops from breakage.

Actually, overshooting will occur in the control characteristics of the slider. Accordingly the range L is designed by taking overshooting into consideration so that the range L is further decreased, thereby lowering the slider resolution during controlling of the slider. Thus, it is advantageous to provide the minimum leeway required for substantially preventing an overshoot of the slider and to cause the stops 106, 112 to absorb the remaining overshooting energy of the slider.

Figure 3:
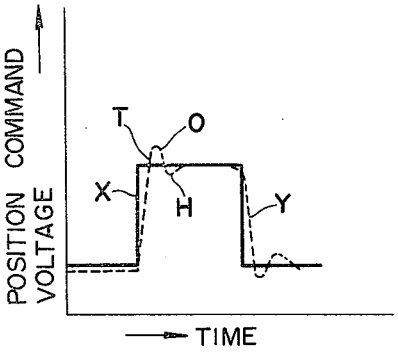
FIG. 3 is a graphical representation of control characteristics of an electric motor.

Experiment has shown the actual movement of the slider versus the command voltage value representing the position of the slider to be as shown in FIG. 3. As will be seen from the broken line Y in FIG. 3, a delay T in response, an overshoot O and hunting H occur in the actual response characteristic of the slider. The external control circuit produces an inverting voltage to effect an electric braking operation in an attempt to prevent a likely overshoot. It is difficult, however, to prevent it completely, leaving a small overshoot O. In order to decrease this overshoot, the inertia mass of the drive system is decreased as much as possible, the maximum speed of the motor is limited, and overshoot is absorbed by stops 106, 108. That is, the buffer members 110, 112 at the stops 106, 108 serve to alleviate the impact imparted to the stops 106, 108 by the slider 74, thereby protecting the structural components of the slider and the motor from mechanical damage.

When the motor 68 is stopped impulsively, the windings of the armature and stator may be displaced from each other with the result that the windings may break, thereby stopping the motor. This particular embodiment is shown as using O-ring oil seals as the buffer members to absorb the impulsive load to prevent breakage of the motor 68.

Figure 4:
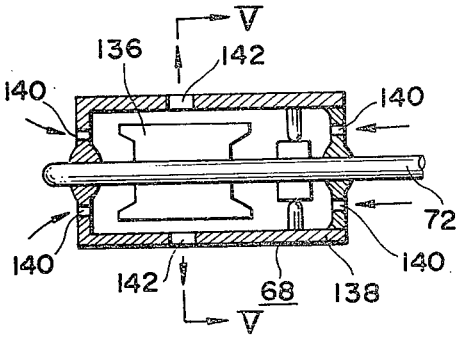
FIG. 4 is a partial sectional view of the essential portion of the second embodiment of the present invention.
Figure 5:
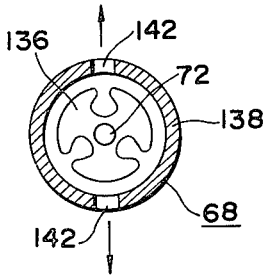
FIG. 5 is a cross-sectional view taken along the line V—V in FIG. 4.

FIGS. 4 and 5 show an alternative to the vanes 104 shown in FIG. 1. The alternative includes the armature 136 of the motor 68 and fuel inlets 140 and fuel outlets 142 provided in the motor casing 138. Thus with this motor, the load on the motor changes according to the amount of fuel fed out, as in a conventional pump. The resistance to the rotation of the armature changes according to the rotational speed thereof, thereby to limit the maximum rotational speed of the motor 68. Thus these embodiments of the present invention improve the stopping of the motor without affecting substantially the rising speed characteristics of the motor.

Figure 6:
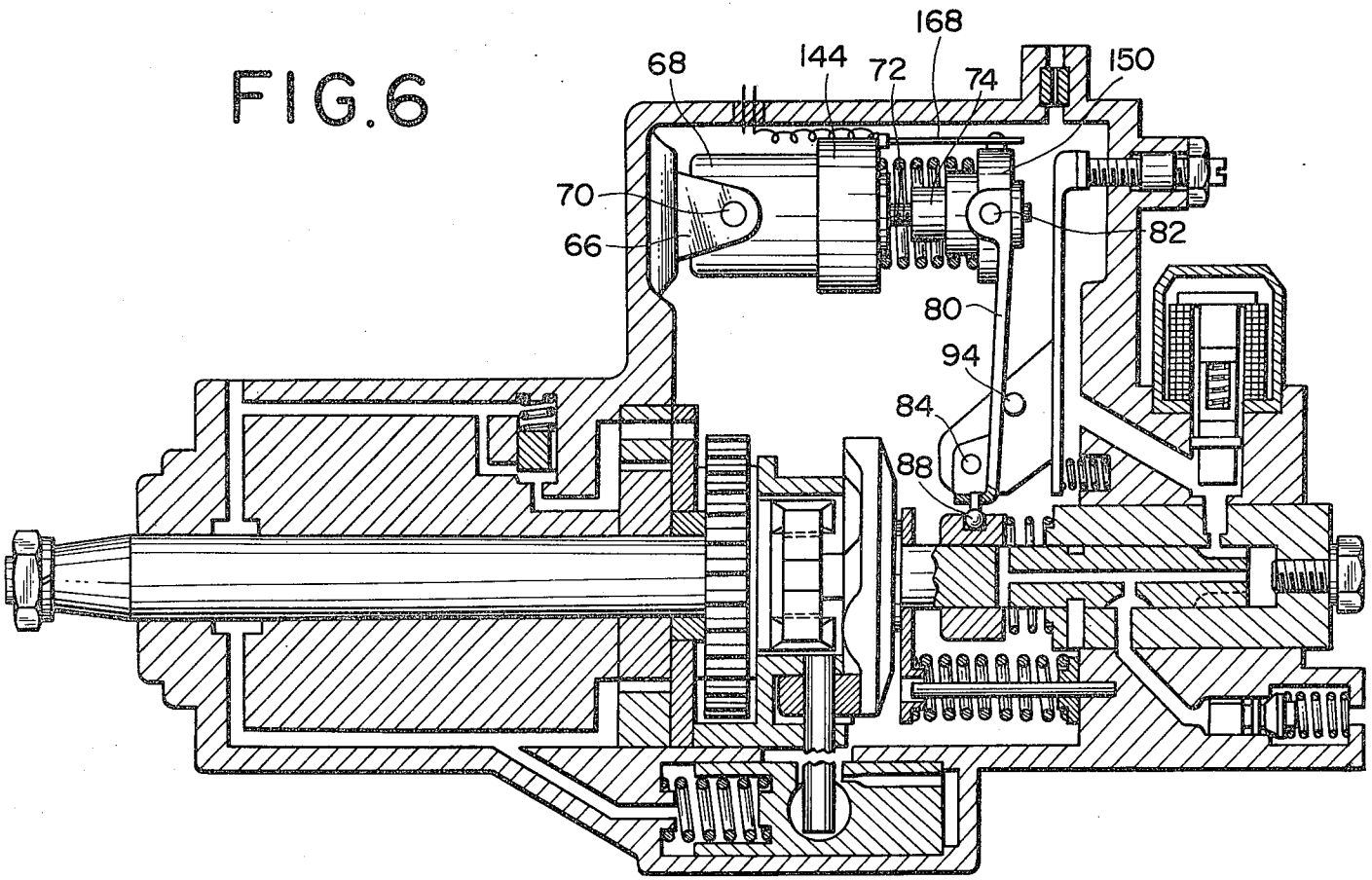
FIG. 6 is a diagrammatical sectional view of a third embodiment of the present invention.
Figure 7:
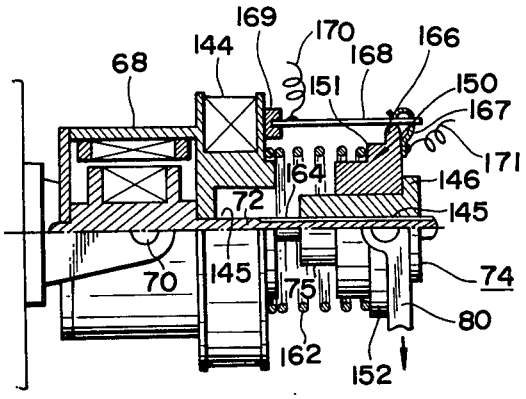
FIG. 7 is a diagramatical partially sectional view on large scale of the motor, solenoid, and slider assembly used in the system of FIG. 6.
Figure 8:
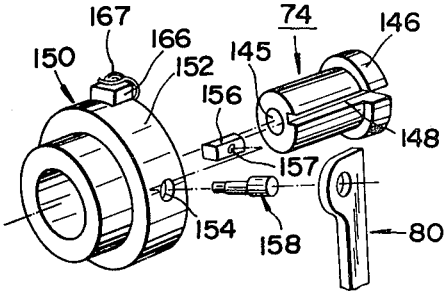
FIG. 8 is an exploded view of the slider and the terminal support members, and the link used in the assembly of FIG. 7.

FIGS. 6, 7 and 8 show a third embodiment of the present invention. This embodiment is the same as the FIG. 1 embodiment except for the following points.

The motor 68, which is of DC type in this particular embodiment, is provided with an insulated solenoid 144 integral therewith which is energized by a signal from the external control device to draw a terminal support member 150 axially relative to the slider toward the motor thereby to rapidly increase fuel injection into the engine during starting of the engine only.

The slider 74 takes the form of a cylinder with a flange 146 at its outer end and includes an axial threaded hole 145 at its center through which the threaded motor shaft 72 is threaded. The slider, made of preferably nonmagnetic material has a groove 148 extending axially in the outer lateral surface thereof. The terminal support member 150 made of a magnetic and, preferably, electrically insulating material takes the form of a ring fitting over the slider cylinder.

The terminal support member has a hole 154 in the outer lateral surface thereof. The slider 74 has a key 156 which is free to slide in the groove 148 in the slider.

A pin 158 extends through the aligned holes 154 and 157 to engage the key and the terminal support member together so that relative rotation cannot occur, but the relative axial movement can occur between the slider and the terminal support member.

A return spring 162 is provided between the solenoid 144 and a shoulder 151 provided on the terminal support member 150 and urges the terminal support member 150 against the slider flange 146. The return spring also serves to bias the slider so as to eliminate any slack in the threaded engagement between the slider and the shaft.

The terminal support member 150 is provided with a contact in the form of a lug 166 and an electrically conductive retaining member 167 in the form of a hook.

A resistor 168, which may taken the form of a strip having a slit extending axially therein, is retained at one end by an insulating retainer 169 secured to the solenoid 144 and is also retained slidably at the other end by the lug 166 and the hook 167 so that the hook 167 may move in the slit provided in the resistor 168, while contacting the same. Thus, the resistance between the retainer 169 and the hook 167 changes as the slider moves along the motor shaft 72 so that the position of the slider is electrically detected through a pair of leads 170 and 171 connected to one end of the resistor 168 and the hook 167, respectively, by the external control device to accurately control the amount of fuel injected into the engine cylinders. This system provides a compact structure, in which substantially all the structural elements are accommodated in the housing 12.

A portion 75 of the slider protruding from the terminal support member 150 is adapted to be received in a recess 145 provided in the solenoid 144, and the left-hand end face of the terminal support member 150 contacts the right-hand end face of the solenoid 144, when the slider is positioned on the extreme left, as viewed in FIG. 7.

Figure 9:
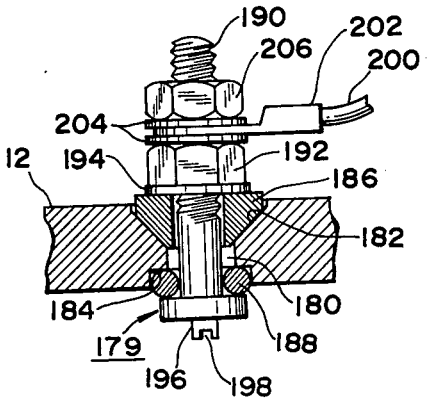
FIG. 9 is a partial sectional view of a terminal suitable for the embodiments of the present invention.

FIG. 9 shows a terminal assembly 179 which is used to connect the motor 68 within the housing 12 and the control device, not shown, outside the housing 12. The assembly includes a through hole 180 provided in the housing 12 and which has a conical portion 182 diverging outward and an inner enlarged portion 184. The assembly further includes a hollow conical insulating member 186 received in the conical hole portion, an O-ring insulating oil seal 188 received in the inner enlarged hole portion, a terminal 190 in the form of a bolt which extends through the through hole, the oil seal, and the insulating member such that the head of the bolt is positioned within the housing 12. A nut 192 tightens the insulating member and the oil seal together with a washer 194 in an oil-tight manner in cooperation with the bolt. The head of the bolt has a lug 196 with a recess 198 which facilitates soldering the motor lead thereto. An external lead 200 is connected through a connector 202 coupled thereto and a pair of washers 204 disposed about the connector therebetween tightened by a nut 206 and the bolt. Thus the terminal bolt 190 is positioned spaced from the housing 12 substantially at the center of the through hole to maintain secure electrical insulation. The oil seal may be made of an oilproof rubber. Thus the housing 12 can withstand internal pressure up to 10 kg/cm$^2$. The use of the terminal assembly improves the system in terms of oil-tightness, pressure-proofness, heat-resistance and vibration-resistance.

Figure 10:
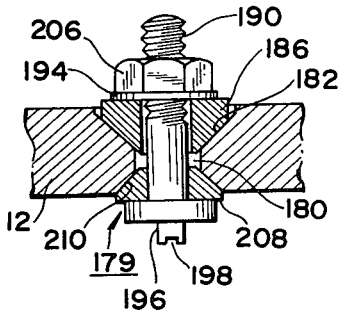
FIG. 10 is a fragmentary sectional view of a modification of the terminal of FIG. 9.

FIG. 10 shows another terminal assembly which is the same as the FIG. 9 assembly except for the use of a hollow conical oil seal 208 in place of the ring-like oil seal, and of a conical hole portion 210 open divergently to the inside of the housing 12 and receiving the conical oil seal 208 in place of the cylindrical hole portion 184 of FIG. 9. This terminal assembly provides substantially the same effects.

It will be understood by those skilled in the art the foregoing description is made in terms of preferred embodiments of the present invention wherein various changes and modifications may be made without departing from the spirit and scope of the invention, as set forth in the appended claims.

What is claimed is:

1. A fuel injection system for an internal combustion engine comprising (a) housing;

(b) a fuel distributing plunger disposed within said housing and moving angularly and axially thereof in synchronism with said engine, said plunger having a spill port opening outwardly;

(c) a control sleeve fitted slidably over said plunger for opening and closing said spill port to control the amount of fuel injected into said engine;

(d) a reversible electric motor disposed within said housing and having a threaded shaft;

(e) a slider disposed within said housing and threaded over said threaded shaft of said motor and movable along said motor shaft by said motor;

(f) a linkage for transmitting movement of said slider to said control sleeve to move the same to open and close said spill port;

(g) sensing means disposed within said housing for sensing electrically the position of said slider along said motor shaft and for outputting a signal representing the position of said slider, said sensing means including a rotational potentiometer having a rotational shaft, a first gear secured thereto, said motor shaft having a second gear secured thereto and meshing with said first gear to drive the same, whereby the angular position of said potentiometer shaft represents the position of said slider along said motor shaft, and (h) at least one vane provided on said second gear subjected to the resistance of fuel within said housing while said motor is being driven, for restricting the maximum speed of said motor, said motor being responsive to an operational state of said engine and to the signal representing the position of said slider to control the position of said slider.

2. A fuel injection system for an internal combustion engine comprising (a) housing;

(b) a fuel distributing plunger disposed within said housing and moving angularly and axially thereof in synchronism with said engine, said plunger having a spill port opening outwardly;

(c) a control sleeve fitted slidably over said plunger for opening and closing said spill port to control the amount of fuel injected into said engine;

(d) a reversible electric motor disposed within said housing and having a threaded shaft;

(e) a slider disposed within said housing and threaded over said threaded shaft of said motor and movable along said motor shaft by said motor;

(f) a linkage for transmitting movement of said slider to said control sleeve to move the same to open and close said spill port;

(g) sensing means disposed within said housing for sensing electrically the position of said slider along said motor shaft and for outputting a signal representing the position of said slider, said motor being responsive to an operational state of said engine and to the signal representing the position of said slider to control the position of said slider, said housing provided with a passage including an outer conical portion divergently open to the outside of said housing and an inner enlarged portion open to the inside of said housing, said system further comprising a terminal assembly received in said passage for connecting said motor to an external control device, said terminal assembly including a first hollow conical insulating member complementarily received in said outer conical portion of said passage, a second hollow seal member received in said enlarged portion of said passage, a terminal in the form of a bolt extending through said passage, said conical insulating member, and said seal member so that the head of said bolt is positioned inside said housing, a pair of nuts tightened over the threaded portion of said bolt, an electrically conductive connecting member clamped between said pair of nuts and connected to an electrical lead to said external control device, said bolt head having a lug with a recess to which an electrical lead to said motor is connected.

3. A fuel injection control system according to claim 2, wherein said inner enlarged portion of said passage is cylindrical, and said seal member is toroidal.

4. A fuel injection control system according to claim 2, where said inner enlarged portion is conical divergently open to the inside of said housing, said seal member being conical.

5. A fuel injection system for an internal combustion engine comprising (a) housing;

(b) a fuel distributing plunger disposed within said housing and moving angularly and axially thereof in synchronism with said engine, said plunger having a spill port opening outwardly;

(c) a control sleeve fitted slidably over said plunger for opening and closing said spill port to control the amount of fuel injected into said engine;

(d) a reversible electric motor disposed within said housing and having a threaded shaft;

(e) a slider disposed within said housing and threaded over said threaded shaft of said motor and movable along said motor shaft by said motor;

(f) a linkage for transmitting movement of said slider to said control sleeve to move the same to open and close said spill port;

(g) sensing means disposed within said housing for sensing electrically the position of said slider along said motor shaft and for outputting a signal representing the position of said slider, said motor being responsive to an operational state of said engine and to the signal representing the position of said slider to control the position of said slider, said sensing means including a rotational potentiometer having a rotational shaft, a first gear secured thereto, said motor shaft having a second gear secured thereto and meshing with said first gear to drive the same, whereby the angular position of said potentiometer shaft represents the position of said slider along said motor shaft, and (h) means for decreasing overshooting of said slider, and therefore of said control sleeve, including at least one vane provided on said second gear subjected to the resistance of fuel within said housing while said motor is being driven, for restricting the maximum speed of said motor.

6. A fuel injection system for an internal combustion engine comprising:

(a) housing;

(b) a fuel distributing plunger disposed within said housing and moving angularly and axially thereof in synchronism with said engine, said plunger having a spill port opening outwardly;

(c) a control sleeve fitted slidably over said plunger for opening and closing said spill port to control the amount of fuel injected into said engine;

(d) a reversible electric motor disposed within said housing and having a threaded shaft, equipped with at least one vane subjected to the resistance of fuel within said housing while said motor is being driven;

(e) a slider disposed within said housing and threaded over said threaded shaft of said motor and movable along said motor shaft by said motor;

(f) a linkage for transmitting movement of said slider to said control sleeve to move the same to open and close said spill port; and (g) sensing means disposed within said housing for sensing electrically the position of said slider along said motor shaft and for outputting a signal representing the position of said slider;

said motor being responsive to the operational state of said engine and to the signal representing the position of said slider to control the position of said slider.

7. A fuel injection system according to claim 6 wherein said housing has a passage including an outer conical portion divergently open to the outide of said housing and an inner enlarged portion open to the inside of said housing, said system further comprising a terminal assembly received in said passage for connecting said motor to an external control device, said terminal assembly including a first hollow conical insulating member complementarily received in said outer conical portion of said passage, a second hollow seal member received in said enlarged portion of said passage, a terminal in the form of a bolt extending through said passage, said conical insulating member, and said seal member so that the head of said bolt is positioned inside said housing, a pair of nuts tightened over the threaded portion of said bolt, an electrically conductive connecting member clamped between said pair of nuts and connected to an electrical lead which is, in turn, connected to said external control device, said bolt head having a lug with a recess to which an electrical lead to said motor is connected.

8. A fuel injection system according to claim 7, wherein said inner enlarged portion of said passage is cylindrical, and said seal member is toroidal.

9. A fuel injection system according to claim 7, wherein said inner enlarged portion is conical and divergently open to the inside of said housing, said seal member being conical.

10. A fuel injection system according to claim 6, wherein said sensing means includes a rotational potentiometer having a rotational shaft, a first gear secured thereto, said motor shaft having a second gear secured thereto and meshing with said first gear to drive the same, whereby the angular position of said potentiometer shaft represents the position of said slider along said motor shaft.

11. A fuel injection system according to claim 6, wherein said linkage comprises a link lever connected pivotably to said slider and said control sleeve and pivotably supported at a stationary point of said housing between said slider and said control sleeve, the ratio of the distance between said stationary point and said slider to the distance between said stationary point and said control sleeve being in the range of 4:1 to 6:1.

* * * * *

UNITED STATES PATENT AND TRADEMARK OFFICE

CERTIFICATE OF CORRECTION

PATENT NO. : 4,470,763

DATED : September 11, 1984

INVENTOR(S) : Seishi Yasuhara

It is certified that error appears in the above-identified patent and that said Letters Patent is hereby corrected as shown below:

Page 1 of the Patent, under "Foreign Application Priority Data", insert:

--June 20, 1980 [JP] Japan Utility Model 55-85673
July 29, 1980 [JP] Japan 55-103143--

Signed and Sealed this

Sixteenth Day of April 1985

[SEAL]

*Attest:*

DONALD J. QUIGG

*Attesting Officer*

*Acting Commissioner of Patents and Trademarks*